US010258831B1

(12) United States Patent
Vance

(10) Patent No.: US 10,258,831 B1
(45) Date of Patent: Apr. 16, 2019

(54) SWIM TRAINING DEVICES

(71) Applicant: Catherine Grander Vance, Austin, TX (US)

(72) Inventor: Catherine Grander Vance, Austin, TX (US)

( * ) Notice: Subject to any disclaimer, the term of this patent is extended or adjusted under 35 U.S.C. 154(b) by 0 days.

(21) Appl. No.: 14/028,253

(22) Filed: Sep. 16, 2013

Related U.S. Application Data

(60) Provisional application No. 61/701,455, filed on Sep. 14, 2012.

(51) Int. Cl.
*A63B 31/00* (2006.01)
*A63B 31/08* (2006.01)
*A63B 31/12* (2006.01)

(52) U.S. Cl.
CPC ..... *A63B 31/12* (2013.01); *A63B 31/00* (2013.01); *A63B 31/08* (2013.01)

(58) Field of Classification Search
CPC ..... A63B 21/00156; A63B 21/0016; A63B 21/1423; A63B 21/1426; A63B 21/143; A63B 69/0057; A63B 69/0059; A63B 69/10; A63B 69/12; A63B 69/125; A63B 69/14; A63B 2069/0062; A63B 31/00; A63B 31/12; A63B 31/02; A63B 31/04; A63B 31/08; A63B 31/10; A63B 31/14; A63B 31/18; A63B 31/11; A63B 2031/112; A63B 2031/115; A63B 2031/117; A63B 21/4039; A63B 2071/125; A41D 13/065; A41D 13/06; A61F 5/0106; A61F 5/0109; A61F 5/0123
USPC ..... 602/26, 62, 75; D21/804, 805
See application file for complete search history.

(56) References Cited

U.S. PATENT DOCUMENTS 3,473,527 A * 10/1969 Spiro ..... A61F 5/0109 602/26
3,739,772 A * 6/1973 Ennis ..... 602/4
3,831,467 A * 8/1974 Moore ..... A61F 5/0109 602/26
4,872,448 A * 10/1989 Johnson, Jr. ..... A41D 13/0568 128/DIG. 20
4,905,991 A * 3/1990 Alston ..... 482/105
5,387,185 A * 2/1995 Johnson, Jr. ..... A61F 5/0585 128/882
5,626,557 A * 5/1997 Mann ..... 602/26
5,700,173 A * 12/1997 Lerro ..... 441/57
5,800,371 A * 9/1998 Winn ..... 602/26
5,865,777 A * 2/1999 Detty ..... 602/26
6,258,014 B1 * 7/2001 Karecki ..... 482/121
6,773,411 B1 * 8/2004 Alvarez ..... A61F 5/0109 602/27
7,484,961 B2 * 2/2009 Blaski et al. ..... 434/247
7,513,881 B1 * 4/2009 Grim ..... A61F 5/0585 128/882
7,837,642 B2 * 11/2010 Herzberg ..... A61F 5/0106 602/23
8,025,632 B2 * 9/2011 Einarsson ..... 602/23
(Continued)

*Primary Examiner* — Nyca T Nguyen
(74) *Attorney, Agent, or Firm* — Dickinson Wright PLLC; Ross Spencer Garsson

(57) ABSTRACT

Swim training devices and methods for portable swim training that assists swimmers in proper swimming alignment. Devices and methods include a leg stroke training system. Devices and methods also include an upper body training system. Such training methods, devices and systems can be used separately or in combination.

8 Claims, 9 Drawing Sheets

(56) References Cited

U.S. PATENT DOCUMENTS

| | | | | |
|---|---|---|---|---|
| 8,753,301 | B2 * | 6/2014 | Tran | 602/16 |
| D763,389 | S * | 8/2016 | Kim | D21/804 |
| 2003/0100853 | A1 * | 5/2003 | Yamasaki | A61F 5/0123 602/16 |
| 2007/0185425 | A1 * | 8/2007 | Einarsson et al. | 602/26 |
| 2009/0144873 | A1 * | 6/2009 | Jewell et al. | 2/24 |
| 2012/0220910 | A1 * | 8/2012 | Gaylord et al. | 602/16 |

* cited by examiner

SWIM TRAINING DEVICES

This application claims the benefit of priority from U.S. Provisional Patent Application No. 61/701,455, filed Sep. 14, 2012, entitled Swim Training Devices, which is incorporated herein by reference.

TECHNICAL FIELD

The present invention relates to swim training devices and methods to use same. The present invention is a portable swim training that assists swimmers in proper swimming alignment. In some embodiments, the present invention is directed to proper leg stroke training. In other embodiments, the present invention is for upper body training. Such training devices can be used separately or in combination.

BACKGROUND

Swimming has long been recognized as one of the most demanding and competitive sports in the world. Over the years, a variety of swimming aids have been developed and used by swimmers to train and improve swim performance. Such aids have been generally designed with the goal of increasing the swimmer's swim stroke efficiency and improving stroke technique and power. Basic to this is that a swimmer must train himself or herself to have proper swimming.

When a person is swimming, he or she need to be in perfect alignment in order to achieve a relaxed state when swimming. The swimmer's head needs to be down and his or her body should be in a level line as if a string was pulling them from the ends of the swimmer's extended finger tips, through the center of top of the swimmer's head, straight through the core, and down the swimmer's straight legs, through the end of the swimmer's pointed but relaxed toes.

In this position there is little or no drag, and, therefore, swimming is accomplished with relaxation (no struggle), and a beautiful stroke occurs with ease.

Proper alignment can be one of the most challenging things for a person to accomplish at any age (or swimming experience). The reason for this is because humans are not conditioned to be in prone positions, and the water is not human's natural environment.

Therefore, swimmers (especially persons learning to swim) typically possess a very mental block situation in their minds. Fear and panic often set in with this unknown situations (prone position), environment, being that the swimmer needs to hold his or her breath and learn to become relaxed. Although it is not a natural environment, a typical person can hold his or her breath comfortably for at least five second.

Beginning swimmers (children and adults) can be take lessons (such as Red Cross Levels 1 & 2) for years with little to no results. The longer the child/adult take lessons that are not successful, the more he or she will not like to put his or her face in a prone position (i.e., underwater while swimming), and the greater fear and anxiety he or she will have about doing so.

Many swimmers also struggle with a sinking problems or work really hard to swim even short distances because the swimmer's legs are bent (i.e., not properly positioned). The swimmer may position his or her legs by just bending at the knee or dropping his or her thighs below the buttocks and do a bicycle movement. Either of these two movements (or other improper movements) will cause the swimmer to struggle as if they are dragging a weight, thus making the swimmer's body come out of alignment, which makes the swimmer exert excessive energy. The swimmer's heart rate will go up, further causing the swimmer not to be relaxed.

Fixing the "bent legs syndrome" is thus important to a proper swimming technique. If a person is not relaxed while swimming, they are struggling, which can lead to exhaustion and panic. By reducing exhaustion and panic, this increases safety of the swimmer.

Accordingly, there is a need for swim training devices for beginning swimmers (and to refresh other swimmers) so that they will more readily learn proper swimming alignment.

SUMMARY OF THE INVENTION

Applicant has developed swim training devices (including leg stroke training devices and upper body training devices) that addressed and overcome these problems.

The leg stroke training device holds the swimmer's legs in the correct prone positions with little or no drag and enables to proper leg position (relatively straight legs) while kicking to produce the proper swim kick.

The upper body training device (also called the upper torso training device) holds the swimmer's neck and bottom of head in perfect alignment, which teaches the swimmer the correct position to be in so the swimmer does not have sinking legs/body (correct body position). As the upper body training device teaches correct neck and head ailment, the rest of the body follows through into a natural prone position. The result is that swimming is accomplished with relaxation (i.e., no struggle), allowing the swimmer to be able to move on to stroke development.

Using the swim training devices, anyone (including young children) can swim as soon as he or she has correct prone ailment (face in).

DESCRIPTION OF DRAWINGS

The foregoing and other objects, features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure.

DETAILED DESCRIPTION

The present invention are swim training devices (all inclusive) that can be utilized as a complete portable trainer outfit and/or utilized as individual training components to train a particular focused area of the swimmer. The training devices include leg stroke training devices and upper body training devices.

Leg Stroke Training Device

The leg stroke training device trains a swimmer to properly perform correct kicks. The leg stroke training device will correct a swimmer's kick allowing him or her to get in correct prone positions with little or no drag and have proper leg position (relatively straight legs) while kicking to produce the proper swim kick. This in turn builds confidence and allows the swimmer to swim with ease.

Using such a device can and has taken years off of swimming lessons to teach these correct kicks. In a standard alignment, it has been found that most swimmers are able to perform correct kick after around eight lessons using the leg stroke training device (as opposed to years of swim lessons).

Accordingly, the leg stroke training device saves time and money associated with swim lessons. Moreover, the decrease in training time also has safety benefits, in that in teaches children more quickly so that they can learn at an earlier age how to swim to the edge of a pool/lake and get out (because the swimmer's legs are propelling him or her properly).

The leg stroke training device keeps the legs in the required prone or supine position during use, therefore, teaching the swimmer how to propel comfortably through the water. Because this device teaches a swimmer how to be efficient with his or her leg movements, the leg stroke training device is also an effective device for training long distance endurance swimmers.

In embodiments of the leg stroke training device, the device addresses and fixes the "bent knee syndrome" by keeping the knees at a slightly flexible/semi-rigid position. This will lead to muscle memory and further lead to relaxed state of mind.

Figure 1A:
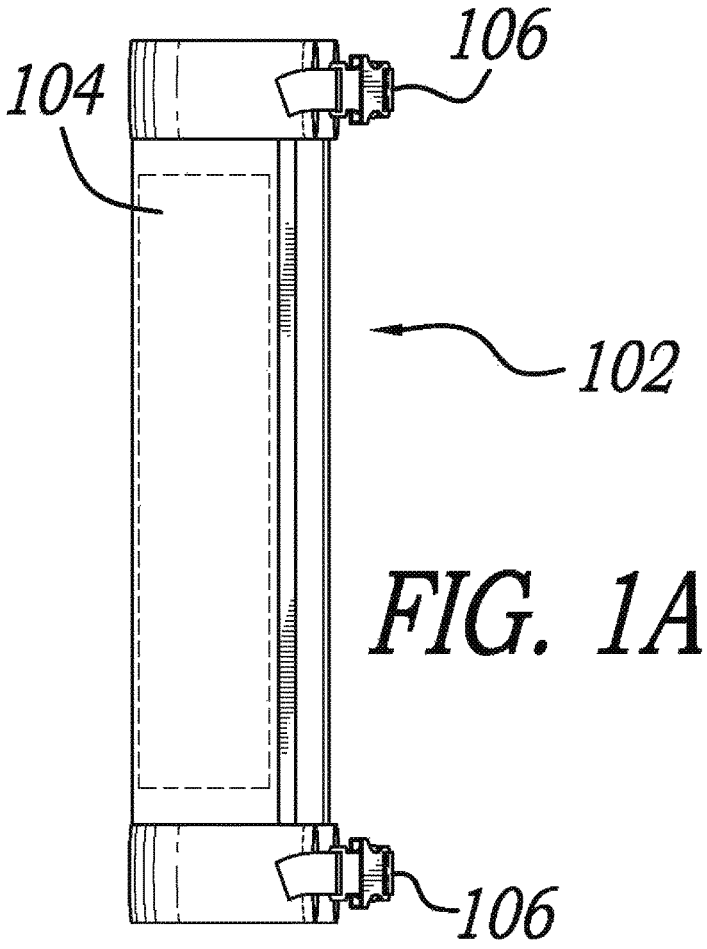
FIG. 1A is an illustration of an embodiment of the leg stroke training device of the present invention.
Figure 1B:
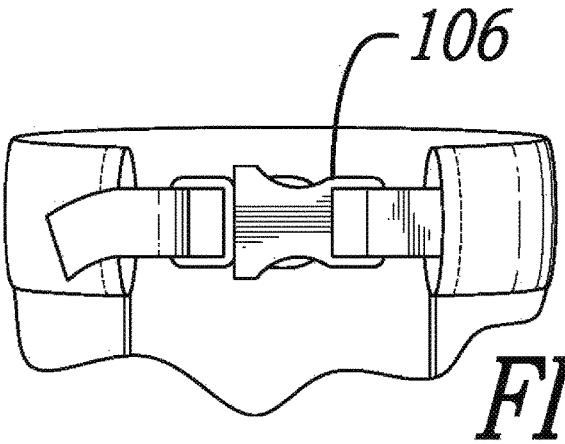
FIG. 1B illustrates a close-up of the adjustable closure of the embodiment illustrated in FIG. 1A.

FIG. 1A is an illustration of an embodiment of the leg stroke training device 100 of the present invention. As illustrated, it shows a sleeve 102 that will fit about the swimmers leg. The sleeve 102 includes an adjustable closure 106 (shown in FIG. 1B) that secures the device around the leg. The sleeve 102 has a pocket 104 inside of which a knee-holding piece 200 can be inserted that controls the angle at which the swimmer's knee is positioned. This piece 200, as discussed in more detail below with reference to FIG. 2, generally has some small amount of flexibility, but is designed to so that the swimmer will naturally maintain the leg at the desired angle when the leg stroke training device is utilized.

The size of the device will vary depending upon the size, age, and weight of the swimmer.

Figure 2:
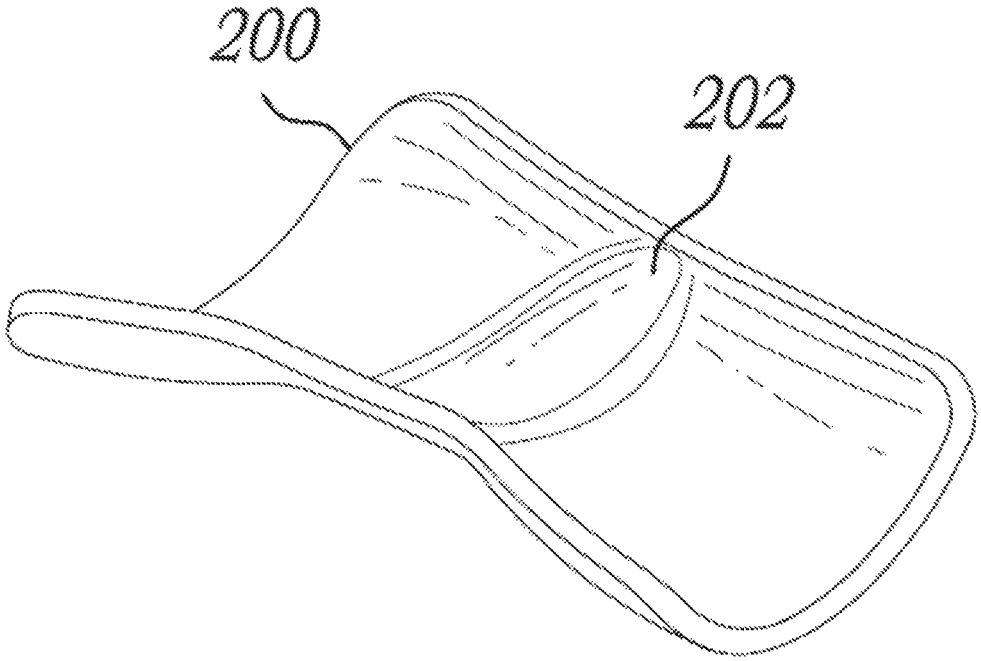
FIG. 2 is a depiction of a portion of a leg stroke training device that can be used in embodiments the present invention, which photograph illustrates the behind the knee portion of the device.

FIG. 2 is a depiction of a rendering in accordance with an embodiment of the knee holding piece 200 that would fit into the sleeve pocket 104 of the leg stroke training device. In some embodiments of the present invention, the leg stroke training device fits behind the knee. In alternative embodiments, the device fits in front of the knee. Thus, the illustration in FIG. 2 provides, for example, how the knee holding piece 200 will be positioned behind the knee portion when utilizing the leg stroke training device, in accordance with some embodiments of the present disclosure. That is, for illustration purposes, area 202 of piece 200, which is a depression area within piece 200, is designed to fit behind the knee of a swimmer.

The leg stroke training device typically bends and maintains the knees at an angle between about 0 degrees and about 30 degrees.

The leg stroke training device can be made to be worn individually as leg stroke trainer itself or in a combination of ways, such as, for example, full sun resistant, long sleeve suits, short sleeve, tank, etc. The leg stroke training device can be included in their swim trunks (such as men's swim trunks).

The leg stroke training device can be made of any material that keeps the knees semi-rigidly at the proper angle. In embodiments of the present invention, the device includes a slightly flexible cushion material or semi-rigid material. This can include, but is not limited to, foams, plastics, metals. Indeed, any known to or to be known materials may be utilized in customizing the leg stroke training device.

Figure 3:
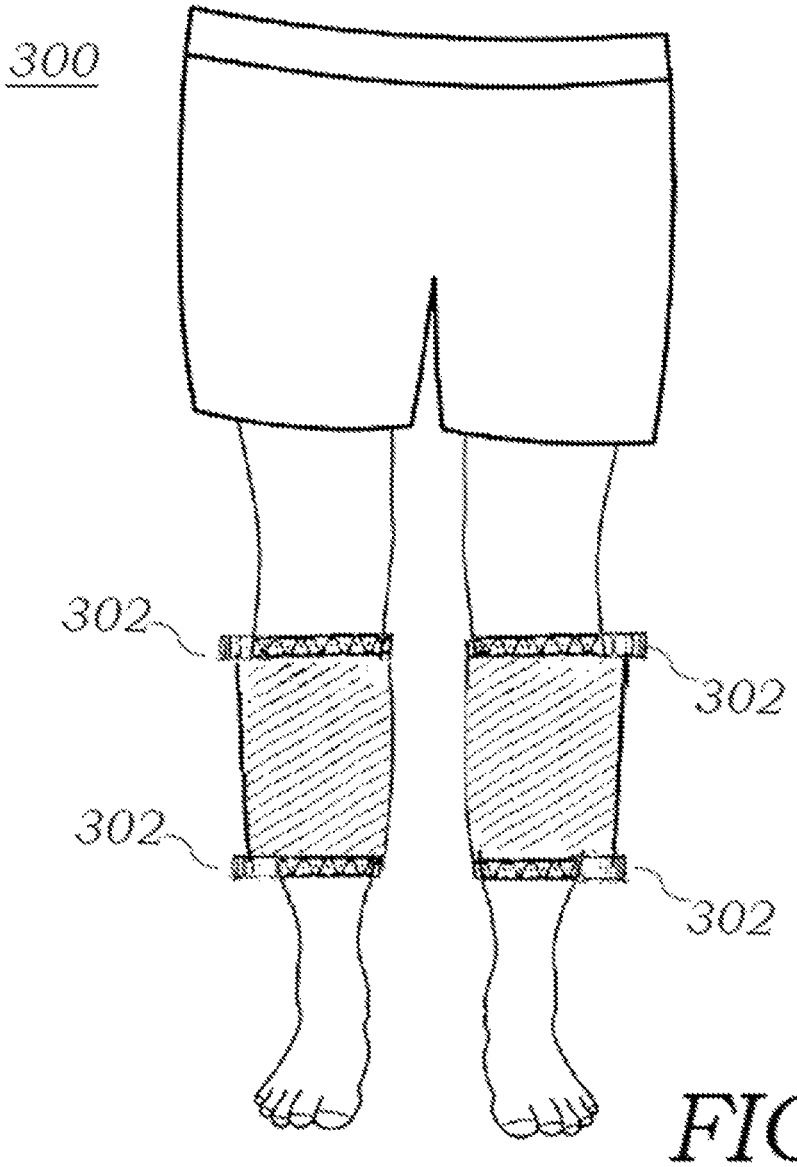
FIG. 3 is an illustration of a front side view of another embodiment of the leg stroke training device of the present invention when worn by a swimmer.
Figure 4:
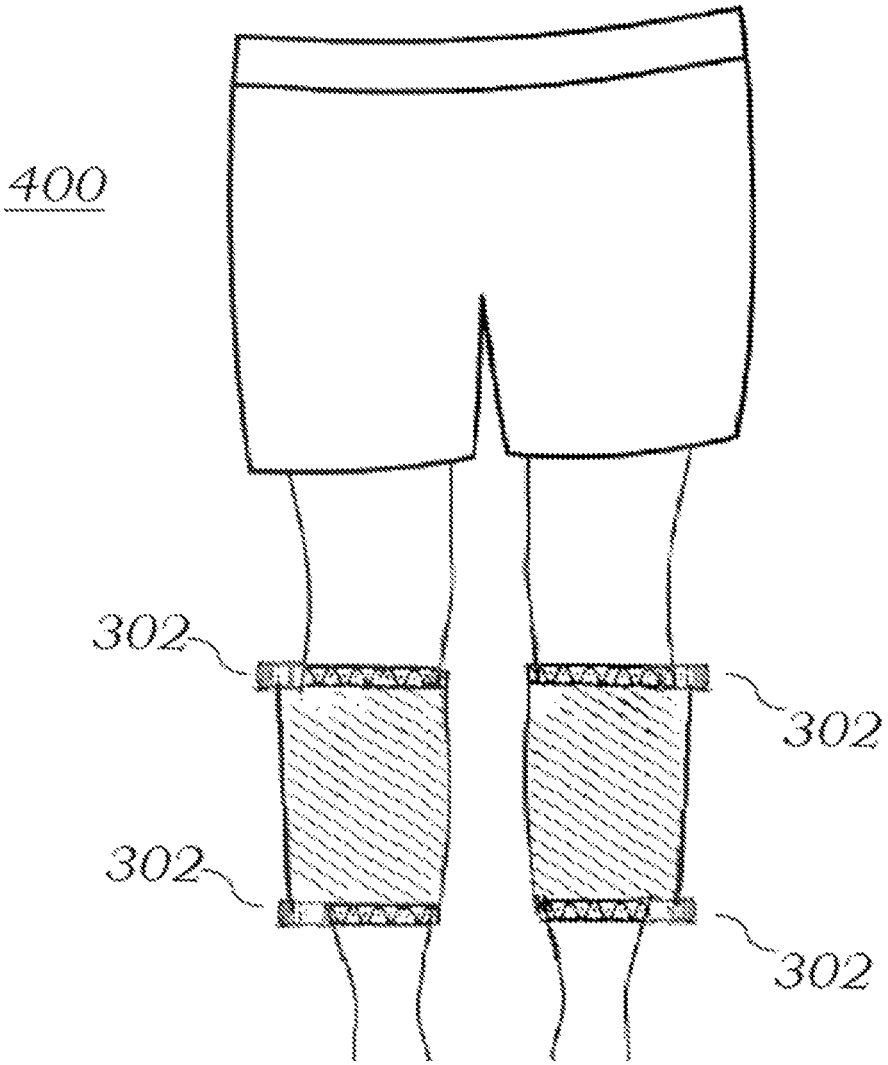
FIG. 4 is an illustration of a back side view of the embodiment of the leg stroke training device shown in FIG. 3 when worn by a swimmer.
Figure 5:
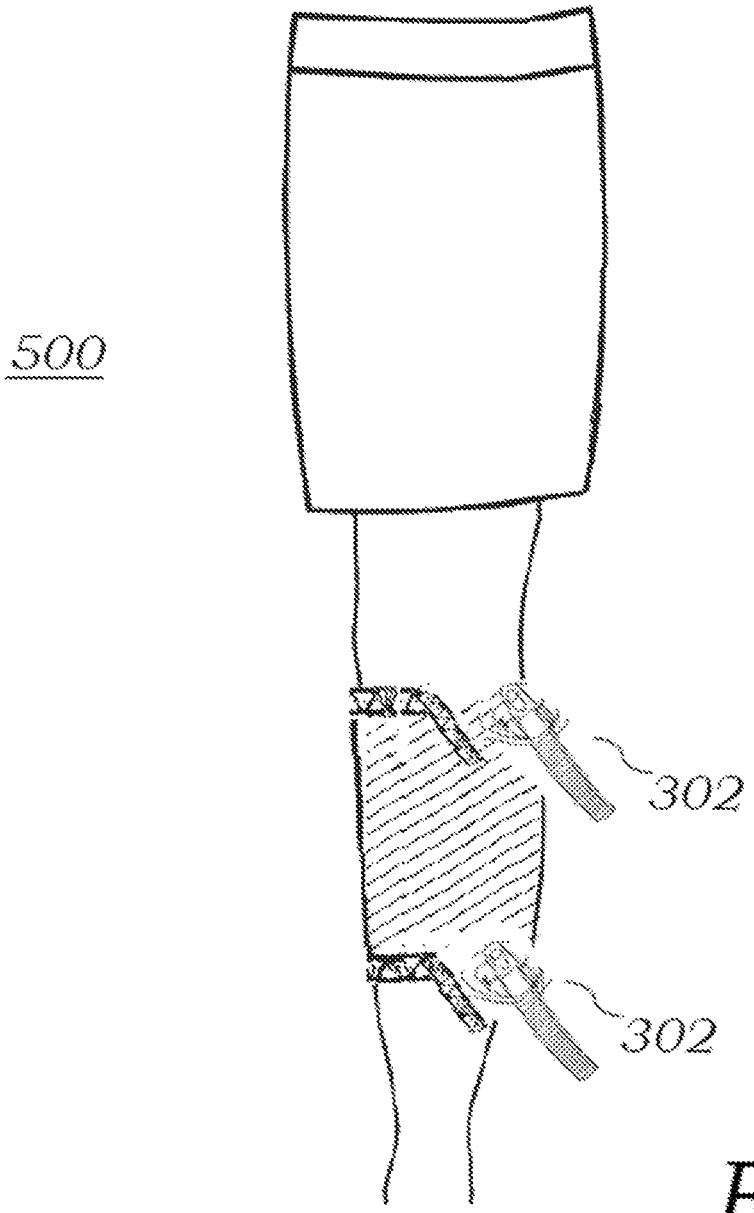
FIG. 5 is an illustration of a side view of the embodiment of the leg stroke training device shown in FIGS. 3-4 when worn by a swimmer.
Figure 6:
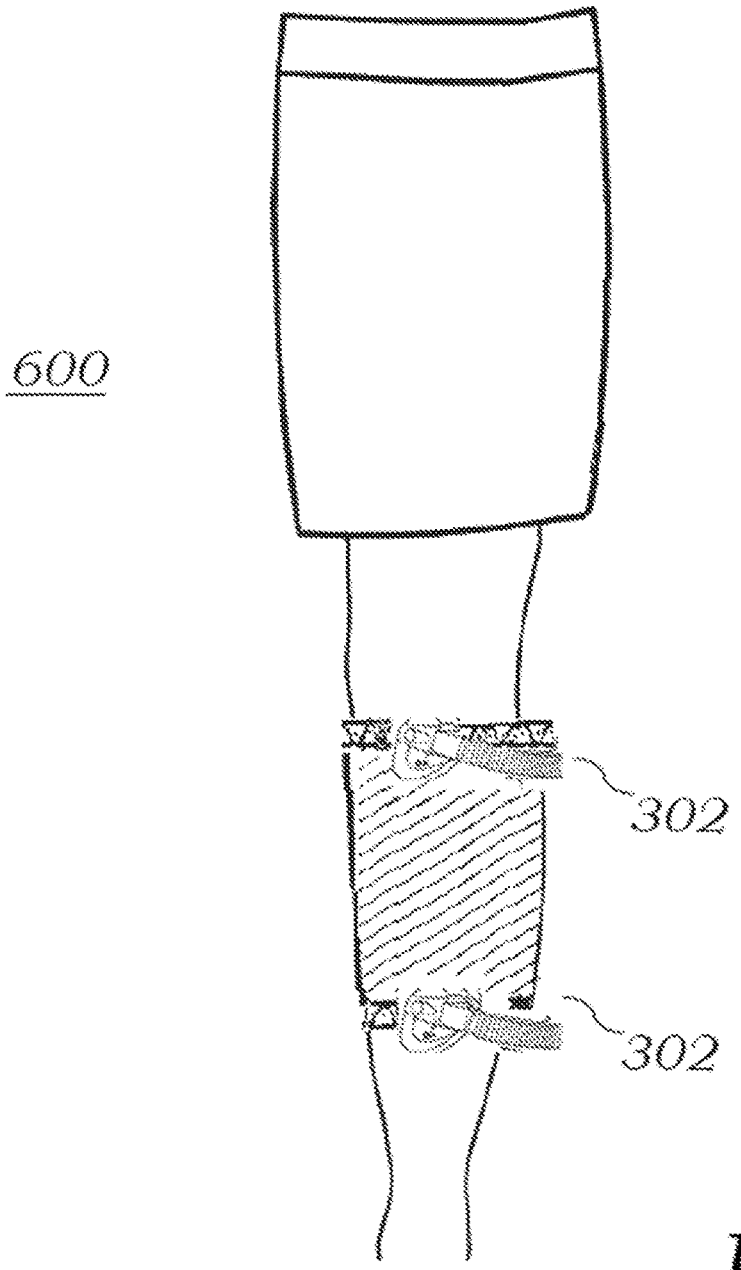
FIG. 6 is an illustration of a side view of the a portion of the leg stroke training device shown in FIGS. 3-5 when worn by a swimmer, which illustration illustrates straps and locking mechanisms within this embodiment of the leg stroke training device.

FIGS. 3-6 illustrate an embodiment of the leg stroke training device of the present invention when worn by a swimmer. FIGS. 3-5 are illustrations of a front side view 300, a back side view 400, and a side view 500, respectively, of a leg stroke training device of the present invention when worn by a swimmer. FIG. 6 is an illustration of a side view 600 of the a portion of the leg stroke training device shown in FIGS. 3-5 when worn by a swimmer, which illustration illustrates the straps and locking mechanisms within this leg stroke training device. That is, as illustrated in FIGS. 3-6, items 302 refer to the straps and locking mechanisms discussed herein, as they provide for affixation of the device to the swimmer's leg.

The material that holds the leg stroke training device together and in place can be made of the materials identified above and/or materials that will allow comfort of the device, such as, but not limited to, cotton, polymers, rubber, neoprene, spandex, nylon, stretch and non-stretch materials, and plastic.

The leg stroke training devices can be latched and adjust to different sizes (depending upon the size and height of the swimmer). The manner in which the device is adjusted to different sizes and heights can be done using the above materials. Such latching (or fastening) can be performed using latches/fasteners, such as those used for life jackets, clicking latches, zippers, hook and loop materials, snapping buttons, and material that fit snug, and any combination of stretch and non-stretch materials, etc.

The leg stroke training device may also encompass side and/or top supports (of the materials listed above) to further enhance the proper motorablity of this portable swim instructor.

The size of the device is generally anywhere from 3 inches for supporting the smallest swimmers up to 12 inches (and above) to support larger of swimmers (fits behind the knee).

This leg stoke training device can include a self leveler or a type of device that detects when swimmer is in prone or is not in prone position to allow the support that is behind knee. This controls the rigidity of the leg stroke training device therefore allowing for firmness while in prone position and making it easy/more comfort while just walking, biking, or doing other activities besides swimming.

By way of a non-limiting example, the self-leveler can be a spring loaded rod (or other locking mechanism) that is engaged when the leg stroke training device is relatively horizontal (within 30 degrees) to position the swimmer's legs in the proper alignment, but the spring loaded rod is not engaged when the leg stroke training device is relatively vertical (within 30 degrees). If desired, the spring load rod (or other locking mechanism) can be designed to compensate for use of the leg stroke training device in water (i.e., in a typical environment of use). It should be understood that the usage of a spring loaded rod should not be construed as limiting as the only applicable locking mechanism, as all known or to be known locking mechanisms are applicable to the presently disclosed embodiments discussed herein.

In use, the leg stroke training device is attached to the swimmer for use when swimming. Generally, the device can be worn as soon as the swimmer can prone float (with his or head in water). In a typically training regime, the swimmer wears the leg stoke training device at first, 100% of the time, and then over time the swimmer is gradually weaned off (like training wheels for a bicycle). Once the leg stroke training devices are taken off, the swimmer is monitored to evaluate the kick without the device. Should the kick remain in form, the device can remain off. However, if knee bending, drag, raised pulse, etc. are noticed immediately, then the device can be placed back on to continue training muscle memory. Moreover, evaluation should be continued over time to make sure there is no regression. If such regression occurs, the leg stroke training device can be placed back on to continue the training.

It has been determined that there can be regression, and a short "refresher" training using the leg stroke training device readily re-establishes the proper leg and kicking alignment.

The leg stroke training device is portable, in that a swimmer should carry the device in his or her swim bag or wear the ones that are built into the swimmer's suit. Some swimmers may just want to keep them on so they can relax and travel easily through the water. For example, these can be used by elder swimmers that do not want to put the energy or time into developing, the perfect stroke or may need the added support of the leg stroke training device to maintain proper form. By more readily maintaining this form, this increases the safety for such elder swimmers. Likewise, tri-athletes can use this training device to conserve energy during competition (in addition to reinforce his or her technique during training).

Upper Body Training Device

With the upper body training device, a person learning to swim can practice the correct prone position on his or her own. The device will also allow the swimmer to get comfortable with his or her face in water.

A problem that many people have relates to putting their faces in the water and relaxing. If a person is struggling while trying to keep his or her head out of the water, the person's legs will sink causing significant drag and making it very difficult for them to get to their destination while swimming. Indeed, proper head alignment is critical to become a real swimmer, because without putting the head in a prone position, the swimmer cannot be relaxed and therefore has a high probability of panicking and drowning (or otherwise injuring themselves).

The upper body training device fixes the "craned head syndrome" by keeping the neck and base of head at a slightly flexible/semi-rigid position. This will lead to muscle memory and further lead to a relaxed state of mind.

With the upper body training device, a swimmer (such as child) can practice perfect prone float and therefore get rid of fear and anxiety of putting his or her face in the water while in the prone position.

Generally everyone, including a child, can hold their breath five seconds so the upper body training device acts as a personal swim instructor. The device breaks the anxiety of the swimmer by putting his or her putting face properly in the water and builds self-confidence in the water because the swimmer can now easily propel him or herself through the water.

The angle of the upper body training device can be between about 0 to about 30 degrees.

The upper body training device thus aligns the swimmer's body in a correct prone position. With this device, any person can learn to become relaxed in prone position. This device thus teaches essentially the most important thing a swimmer needs to learn in order to accomplish becoming a swimmer. Moreover, if a person can swim but is having difficulties with his or her body dragging or have trouble relaxing shoulders, neck, and/or head in water, the upper body training device will put that person in perfect ailments to swim with relaxation and ease.

Utilizing embodiments of the upper body training device has been shown to take significant time (months/years) off of lessons to get the correct body/head position for swim. In practice, it has been found that a typical swimmer using the upper training device can learn to properly swim in around eight sessions.

Figure 7:
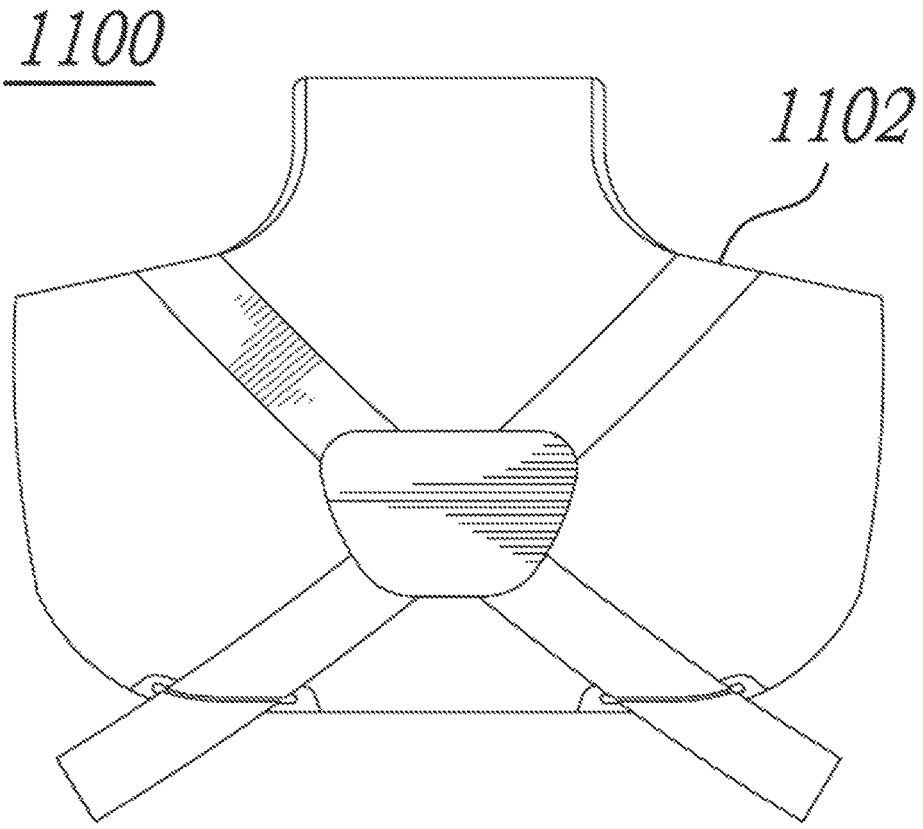
FIG. 7 is an illustration of an embodiment of the upper body training device of the present invention (including securing plate and shoulder/neck insert portion).
Figure 8:
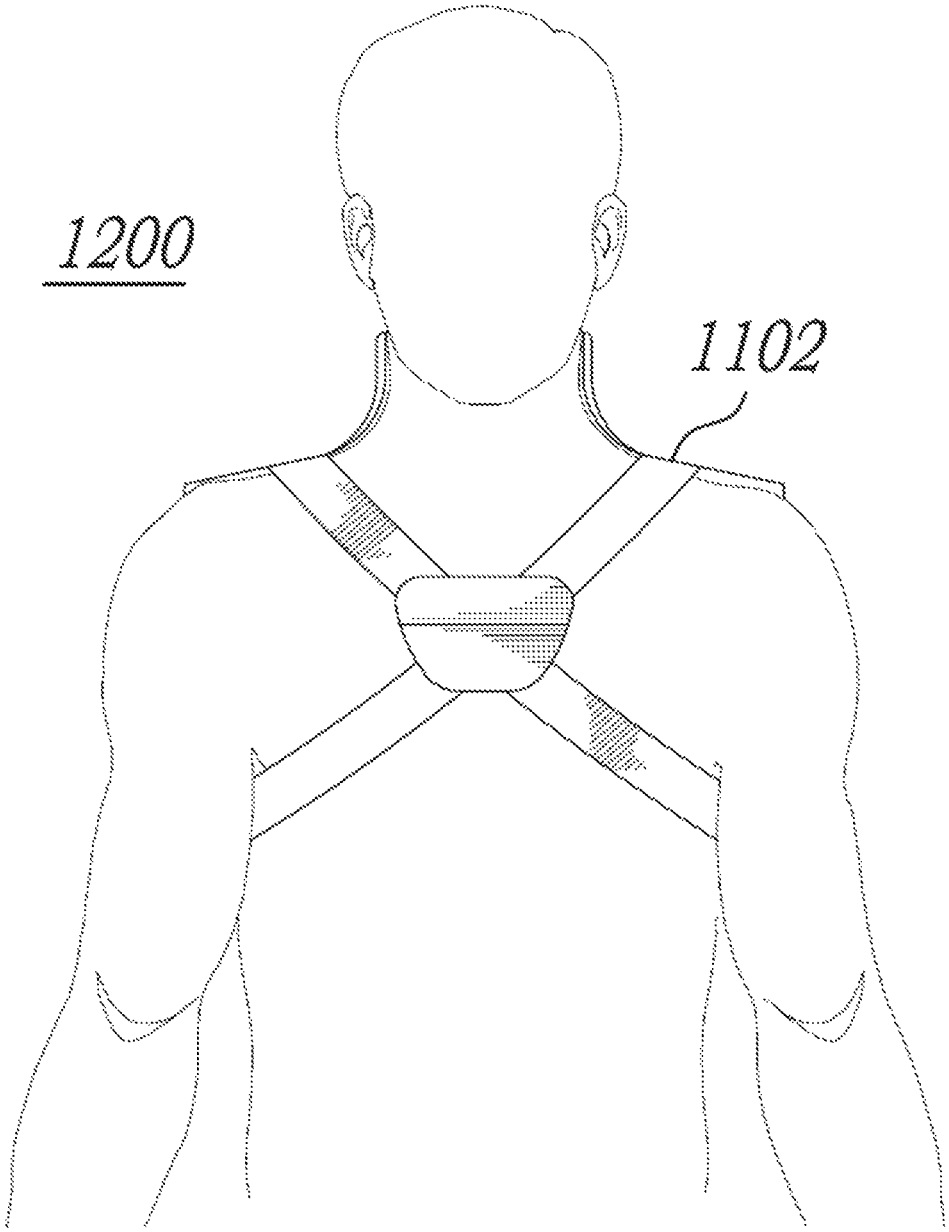
FIG. 8 is an illustration of a front side view of the embodiment of the upper body training device shown in FIG. 7 when worn by a swimmer.
Figure 9:
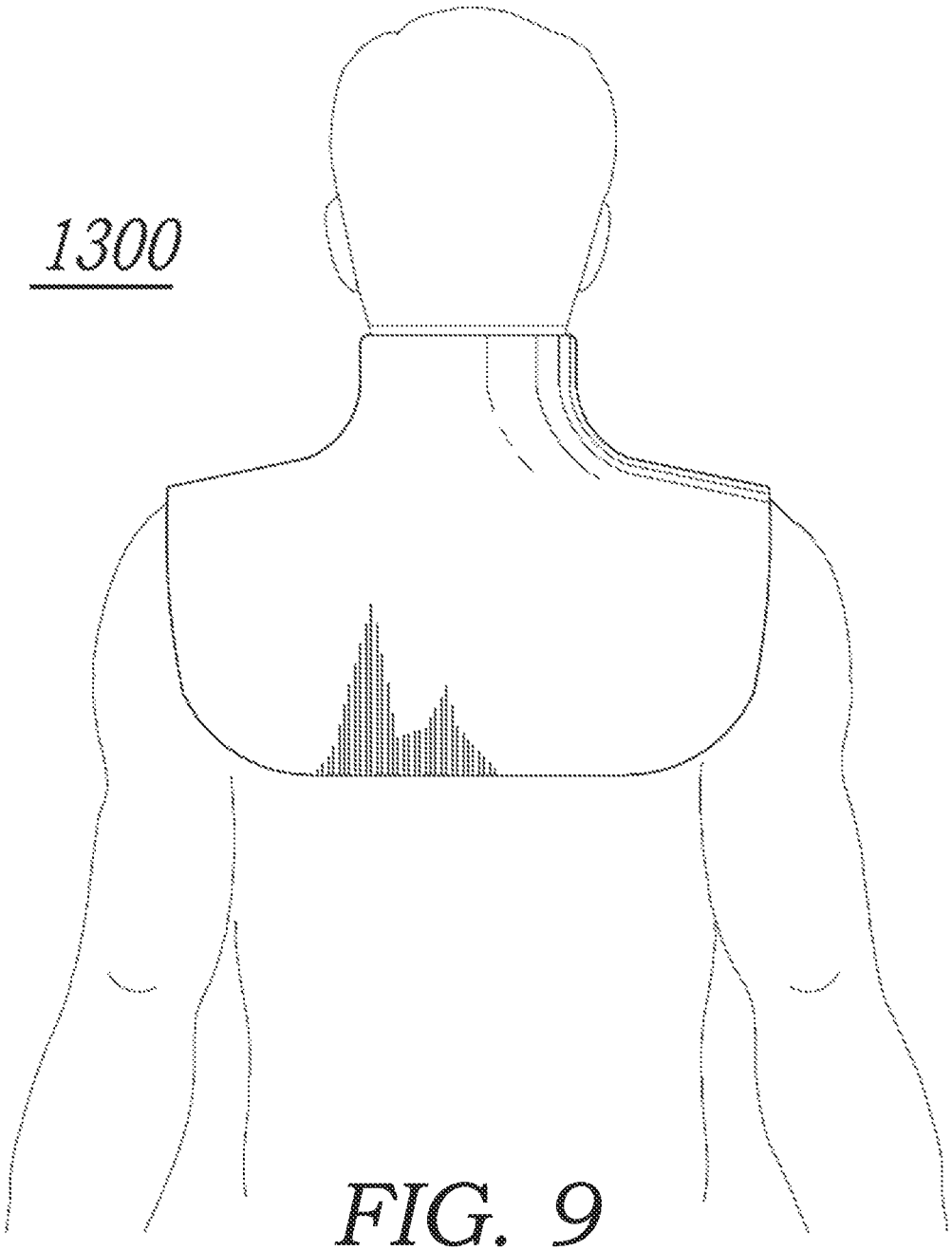
FIG. 9 is an illustration of a back side view of the embodiment of the upper body training device shown in FIG. 7 when worn by a swimmer.

FIGS. 7-9 illustrate an embodiment of an upper body training device of the present invention. This embodiment uses straps and a securing plate to keep the upper body training device positioned properly. FIG. 7 is an illustration of this embodiment (not being worn by a swimmer); the shoulder/neck portion 1100 with adjustable closures 1102 (e.g., straps) as discussed herein. FIGS. 8-9 are illustrations of a front side view 1200 and a back side view 1300, respectively, of the upper body training device shown in FIG. 7 when worn by a swimmer.

The upper body training device can be made of similar materials as listed above for the leg stroke training device.

The upper body training device can be in a suit that has floatation (buoyant) inserts that can be taken out or left in to keep swimmer in proper perfect prone position, which will allow swimming with ease and allow the swimmer to become relaxed for distance swimming.

The upper body training device can also have a turtle neck in which an insert can be placed to prevent craning by the swimmer.

The upper body training device can also have inserts along sides from the underarm to the buttocks of the swimmer.

The upper body training device can also have inserts along the sides of legs of the swimmer in full suits, in trainer only, or in trunks.

The upper body training device can be made to be worn individually as the trainer by itself, or in a combination of ways, such as full sun resistant long sleeve suits, short sleeve, or tanks.

The upper body training device can be made of any material that keeps the upper body in the proper angle. A slightly flexible cushion material or semi-rigid material can be used, such as foams, rubber, gel, plastics, or metals.

In some embodiments, the upper body training device fits behind the base of head, neck, and across the back of the shoulders of the swimmer. It can be an insert capable of being removed out of a swim top. However, the insert needs to stay in place when using the upper body training device to train the swimmer's muscles memory, and the ability to relax and be confident in the water.

The material that holds the upper body training device together is made of the same materials as identified above will allow comfort of the product, such as cotton, polymers, rubber, neoprene, spandex, nylon, and stretch and non-stretch materials (such as plastic).

The upper body training device ability to latch/fasten or adjust to different sizes can be performed using the materials described above. Some of latches/fasteners include latches like life jackets, clicking latches, zippers, hook and loop material, snapping buttons, and materials that fit snug and any combination of and any and all materials stretch and non-stretch with fasteners.

The upper body training device may also encompass side and/or top supports of all materials to further enhance the proper motor ability of the portable swim instructor.

The size of the upper body training device can be anywhere to fit one-year old swim tops supporting small swimmers to very large adult swimmers (i.e., through adult XXL and larger)

The upper body training device can include a self leveler or a type of device that detects when a swimmer is in prone or is not in prone position to allow the support that is behind the base of head, neck, and across back of shoulders and controls the rigidity of the upper body training device allowing for firmness while in prone position and making it easy/more comfortable while just walking, sitting, biking, or performing other activities. The angle of this part can range from about 0 to about 30 degrees.

A number of embodiments of the invention have been described. Nevertheless, it will be understood that various modifications may be made without departing from the spirit and scope of the invention. Accordingly, other embodiments are within the scope of the following claims.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above, but is only limited by the claims which follow, that scope including all equivalents of the subject matter of the claims.

What is claimed is:

1. A swim training device arranged to be worn about a leg of a swimmer, comprising:

(a) a sleeve formed from a single sheet of material that is arranged to fit behind a knee of the swimmer, wherein connected to the sleeve is an adjustable closure for securing the sleeve around the leg of the swimmer, and the sleeve is arranged to hold a removable knee-holding piece; and (b) the knee-holding piece is a single piece of a semi-rigid material and comprising a depression area, wherein (i) the depression area of the knee-holding piece is formed to fit behind the knee of the swimmer and has an area to cover predominately the entire area behind the knee of the swimmer, (ii) the sleeve holds the knee-holding piece to position the depression area of the knee-holding piece behind the knee of the swimmer with the depression area of the knee holding-piece covering predominately the entire area behind the knee of the swimmer when the swim training device is worn about the leg of the swimmer, and (iii) the knee-holding piece is operable for limiting flexibility of the knee of the swimmer when the swim training device is worn about the leg of the swimmer while the swimmer is swimming and the depression area of the knee-holding piece is behind the knee of the swimmer.

2. The swim training device of claim 1, wherein the sleeve has an adjustable size and said adjustable closure is operable for adjusting the adjustable size of the sleeve to correspond to a size that fits the swimmer.

3. The swim training device of claim 2, wherein the adjustable size of the sleeve ranges from 3 inches to 12 inches.

4. The swim training device of claim 1, wherein the knee-holding piece naturally maintains the leg of the swimmer at a desired angle, wherein the desired angle is between 0 degrees and 30 degrees.

5. The swim training device of claim 1, wherein the sleeve is further arranged to fit in front of the knee of the swimmer.

6. The swim training device of claim 1, wherein the sleeve holds the knee-holding piece to position the depression area laterally behind the knee of the swimmer and transverse the leg of the swimmer when the swim training device is worn about the leg of the swimmer.

7. A pair of swim training devices comprising a first swim training device arranged to be worn about a first leg of a swimmer and a second swim training device arranged to be worn about the second leg of the swimmer, wherein (A) the first swim training device comprises (a) a first sleeve arranged to fit behind a first knee of the first leg of the swimmer, wherein connected to the first sleeve is a first adjustable closure for securing the first sleeve around the first leg of the swimmer, and the first sleeve is arranged to hold a removable first knee-holding piece; and (b) the first knee-holding piece is a first single piece of a first semi-rigid material and comprising a first depression area, wherein (i) the first depression area of the first knee-holding piece is formed to fit behind the first knee of the swimmer and has an area to cover predominately the entire area behind the first knee of the swimmer, (ii) the sleeve holds the first knee-holding piece to position the first depression area of the first knee-holding piece behind the first knee of the swimmer with the first depression area of the first knee-holding piece covering predominately the entire area behind the first knee of the swimmer when the first swim training device is worn about the first leg of the swimmer, and (iii) the first knee-holding piece is operable for limiting flexibility of the first knee of the swimmer when the first swim training device is worn about the first leg of the swimmer while the swimmer is swimming and the first depression area of the first knee-holding piece is behind the first knee of the swimmer; and (B) the second swim training device comprises (a) a second sleeve arranged to fit behind a second knee of the second leg of the swimmer, wherein attached to the second sleeve is a second adjustable closure for securing the second sleeve around the second leg of the swimmer, and the second sleeve is arranged to hold a removable second knee-holding piece; and (b) the second knee-holding piece is a second single piece of a second semi-rigid material and comprising a second depression area, wherein (i) the second depression area of the second knee-holding piece is formed to fit behind the second knee of the swimmer and has an area to cover predominately the entire area behind the second knee of the swimmer, (ii) the second sleeve holds the first knee-holding piece to position the second depression area of the second knee-holding piece behind the second knee of the swimmer with the second depression area of the second knee-holding piece covering predominately the entire area behind the second knee of the swimmer when the second swim training device is worn about the second leg of the swimmer, and (iii) the second knee-holding piece is operable for limiting flexibility of the second knee of the swimmer when the second swim training device is worn about the second leg of the swimmer while the swimmer is swimming and the second depression area of the second knee-holding piece is behind the second knee of the swimmer.

8. The swim training device of claim 7, wherein (a) the first sleeve holds the first knee-holding piece to position the first depression area laterally behind the first knee of the swimmer and transverse the first leg of the swimmer when the swim training device is worn about the first leg of the swimmer; and (b) the second sleeve holds the second knee-holding piece to position the second depression area laterally behind the second knee of the swimmer and transverse the second leg of the swimmer when the swim training device is worn about the second leg of the swimmer.

* * * * *